United States Patent [19]

Muller

[11] 4,452,118

[45] Jun. 5, 1984

[54] SHAKE RESAW MACHINE

[76] Inventor: Reinhard Muller, 9425 Carleton St., Chilliwack, British Columbia, Canada

[21] Appl. No.: 447,440

[22] Filed: Dec. 6, 1982

[51] Int. Cl.[3] ..... B27M 3/02; B26D 3/30

[52] U.S. Cl. ..... 83/871; 83/156; 83/420; 83/423; 83/424; 83/425; 83/428; 83/436; 83/446; 83/449; 83/874

[58] Field of Search ..... 83/871, 874, 425, 156, 83/436, 428, 423, 424, 420, 413, 412, 732, 449, 446, 445

[56] References Cited

U.S. PATENT DOCUMENTS

| | | | |
|---|---|---|---|
| 1,482,711 | 2/1924 | Sorenson | 83/871 |
| 2,685,311 | 8/1954 | Ferrari | 83/871 X |
| 4,089,355 | 5/1978 | Dueck | 83/871 X |
| 4,291,601 | 9/1981 | Guynup | 83/871 X |

*Primary Examiner*—Frank T. Yost

*Attorney, Agent, or Firm*—Hughes, Barnard & Cassidy

[57] ABSTRACT

A shake resaw machine for converting a generally rectilinear wooden blank into a pair of oppositely tapered shingles, each having a tip and a butt end, is comprised of a support table hingedly disposed for cooperative engagement with a saw for lateral movement with respect to a longitudinal feed axis along which the wooden blank progresses during a resaw sequence through the saw, including a first tip-cutting stage, an intermediate diagonal-cutting stage, and a second tip-cutting stage, a table control member for moving the support table at a predetermined rate in a lateral path relative to the feed axis during the resaw sequence, first and second blank guide members having variable lateral stiffness, one of each disposed on either side of the feed axis forwardly proximate a saw blade location thereon, for cooperatively routing the blank along a variable, predetermined resaw path, and first and second guide control members for regulating, respectively, the lateral stiffness of the first and second guide members during the resaw sequence permitting lateral deflection of the first guide control member during the first tip-cutting stage and establishing guiding-effective stiffness in that member to provide a generally rigid guiding surface for the blank during the remainder of the sequence and for permitting lateral deflection of the second guide member during the second tip-cutting stage while establishing guiding-effective stiffness in that member to provide a generally rigid guiding surface for the blank during the remainder of the sequence.

19 Claims, 14 Drawing Figures

SHAKE RESAW MACHINE

BACKGROUND OF THE INVENTION

1. Field of the Invention

The present invention relates, generally, to apparatus for making shingles and, more especially, to an improved shake resaw apparatus for converting a rectilinear wooden blank into a pair of oppositely tapered wooden shingles.

2. Description of the Background Art

So-called "shake shingles" are very popular roofing and siding materials in the building trade. Customarily, the same are fabricated from cedar in the form of a tapered shingle having a tip end and a butt end destined for overlapping application to, e.g., the roof of a building structure. All manner and variety of dimensions are employed; nominal sizes ranging on the order of about 24" inches in length, about 10" in width, and tapering from about ¾-1" at the butt to about ⅝" at the tip.

For many years these shake shingles were hand-split, beginning with a large block of cedar and subdividing it manually into the desired dimensions through a very laborious splitting process. Old-growth cedar was found far preferable to second-growth due to the considerably greater grain tightness of the former, both in respect of the ease of splitting and the resulting product.

With the rapid depletion of old-growth cedar and the need for more efficient methods came mechanization in the manufacture of shake shingles. Sawing machines were developed for converting split blanks into shingles by sawing along a diagonal of the blank. Representative of patented apparatus for this purpose are U.S. Pat. No. 4,291,601 and 3,171,450. These apparatus not only made simpler the manufacture of shake shingles from wooden blanks, they accommodated the problems associated with the use of second-growth cedar in this context as the same tends to be much more open in the grain and the blanks have a tendency toward random curvature, waviness, and general nonuniformity.

While many strides have been made in this regard, the apparatus heretofore proposed themselves tend to be quite complicated in design. The need to resort to complicated, elaborate mechanisms has contributed in turn to equally complicated methods of manufacture and routine maintenance to insure dependable operation.

SUMMARY OF THE INVENTION

The present invention advantageously provides a shake resaw machine and, more specifically, an improved feed and guide apparatus therefor, which is of simple design but which nonetheless provides dependable and uniform results in the fabrication of shake shingles. The apparatus of the present invention is particularly desirable for its ability to produce uniform tip thicknesses at either end of a wooden blank over dimensional ranges and range variations heretofore achievable, if at all, only through very tedious and expensive efforts.

The foregoing and other advantages of the present invention are realized in one aspect thereof by a shake resaw apparatus for converting a generally rectilinear wooden blank into a pair of oppositely tapered shingles, each having a tip and a butt end, comprising a support table hingedly disposed for cooperative engagement with saw means for lateral movement with respect to a longitudinal feed axis along which the wooden blank progresses during a resaw sequence through the saw means, including a first tip-cutting stage, an intermediate diagonal-cutting stage, and a second tip-cutting stage, table control means for moving the support table at a predetermined rate in a lateral path relative to the feed axis during the resaw sequence, first and second blank guide means having variable lateral stiffness, one of each disposed on either side of the feed axis forwardly proximate a saw blade location thereon, for cooperatively routing the blank along a variable, predetermined resaw path, first guide control means for regulating the lateral stiffness of the first blank guide means during the resaw sequence, permitting lateral deflection thereof during the first tip-cutting stage and establishing guiding-effective stiffness to provide a generally rigid guiding surface for the blank during the remainder of the sequence, and a second guide control means for regulating the lateral stiffness of the second blank guide means during the resaw sequence, permitting lateral deflection thereof during the second tip-cutting stage and establishing guiding-effective stiffness to provide a generally rigid guiding surface for the blank during the remainder of the sequence. In a preferred embodiment, the blank guide means are each comprised of at least one generally transverse array of a plurality of semi-independent guide finger means ganged for collective, variable biased response to the respective one of the guide control means and individual lateral deflection upon contact with surface irregularities in the blank. In a highly preferred adaptation, each of the transverse arrays is comprised of an array of guide fingers having proximal and distal ends disposed for lateral pivotal movement about a pivot point intermediate the length thereof, roller means at the distal ends of the fingers for contacting the blank, variable biasing means at the proximal ends of the fingers urging the fingers toward pivotal movement in a direction counter to that of the feed, which biasing means are in operative communication with the guide control means for regulating the biasing force thereon, and stop means disposed intermediate the pivot point and the proximal end for limiting the pivotal movement of the fingers in the biased direction (i.e., counter the resaw path). Most preferably, each of the blank guide means is comprised of two of such arrays of guide fingers disposed in spaced relationship with the roller means lying along a line generally parallel to the feed axis and adjustably displaced therefrom in an outwardly lateral direction to provide a guiding surface for the blank when the guide means are tensioned by the control means as aforesaid. The distance separating the roller means from the feed axis controls the tip dimension for each of the shingles formed from a single blank, that of the first guide means controlling the tip width during the second tip-cutting stage and vice versa; both assemblies being laterally adjustable to vary the tip width(s).

The shake resaw apparatus of the present invention preferably further includes floating, self-aligning infeed and outfeed rollers disposed respectively forward and rearward of the saw location for driving the blank along the resaw path. The apparatus still further preferably comprises a conveyor for delivering (*seriatim*) blanks to be sawn therein. In such a case, timing means are further included, and especially timing means which provide a slightly faster angular speed for the rollers than the linear speed of the conveyor so that the rollers positively grasp a blank as it is presented.

In the most preferred embodiment of the present invention, the control means for the table and also the guide members are cam means with associated cam followers and linkage members leading to the cooperative elements. Hence, table positioning and speed are regulated by suitable shaping of a table cam while the variable stiffness for the guide members is likewise achieved by appropriate cam programming.

Other features and advantages of the present invention will become more apparent, and a fuller understanding of its construction and mode of operation will be gained, upon an examination of the following detailed description of preferred embodiments, taken in conjunction with the figures of drawing, wherein:

DETAILED DESCRIPTION OF THE INVENTION

The present invention relates, generally, to shinglemaking apparatus and, more especially, to shake resaw machines for converting a wooden blank into a pair of oppositely tapered shingles useful for roofing or siding material. Accordingly, the invention will now be described with reference to certain preferred embodiments within such a context; albeit, those skilled in the art will appreciate that such a description is meant to be exemplary only and should not be deemed limitative as many equivalent structures might be employed to achieve the goals of the present invention without departing from its broader spirit.

Figure 1:
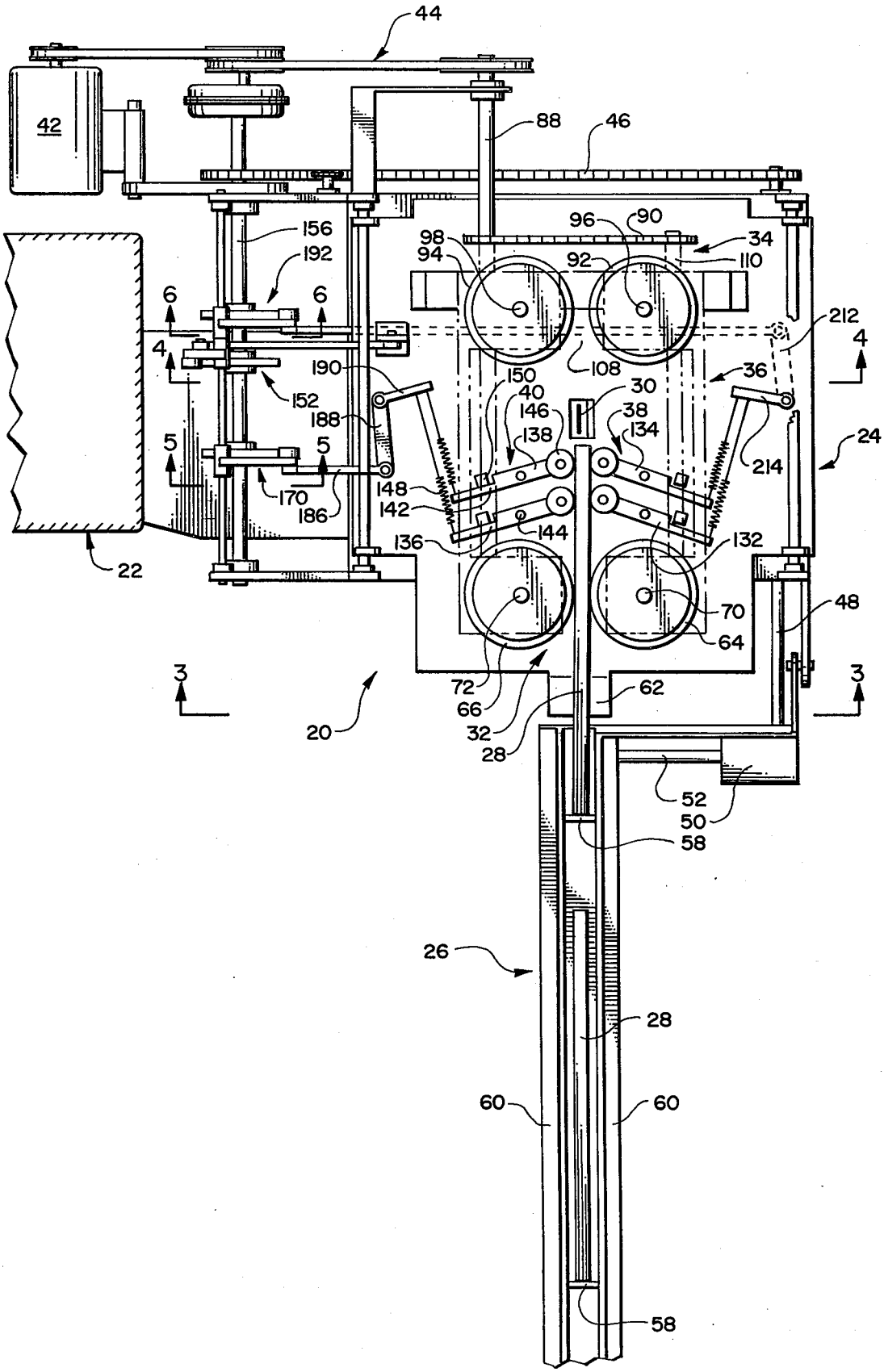
FIG. 1 is a top plan view of a shake resaw apparatus in accordance with the present invention, including a band saw for converting a wooden blank delivered by conveyor means into a pair of oppositely tapered shingles, shown in the initial stage of a resaw sequence, with parts broken away for clarity.
Figure 2:
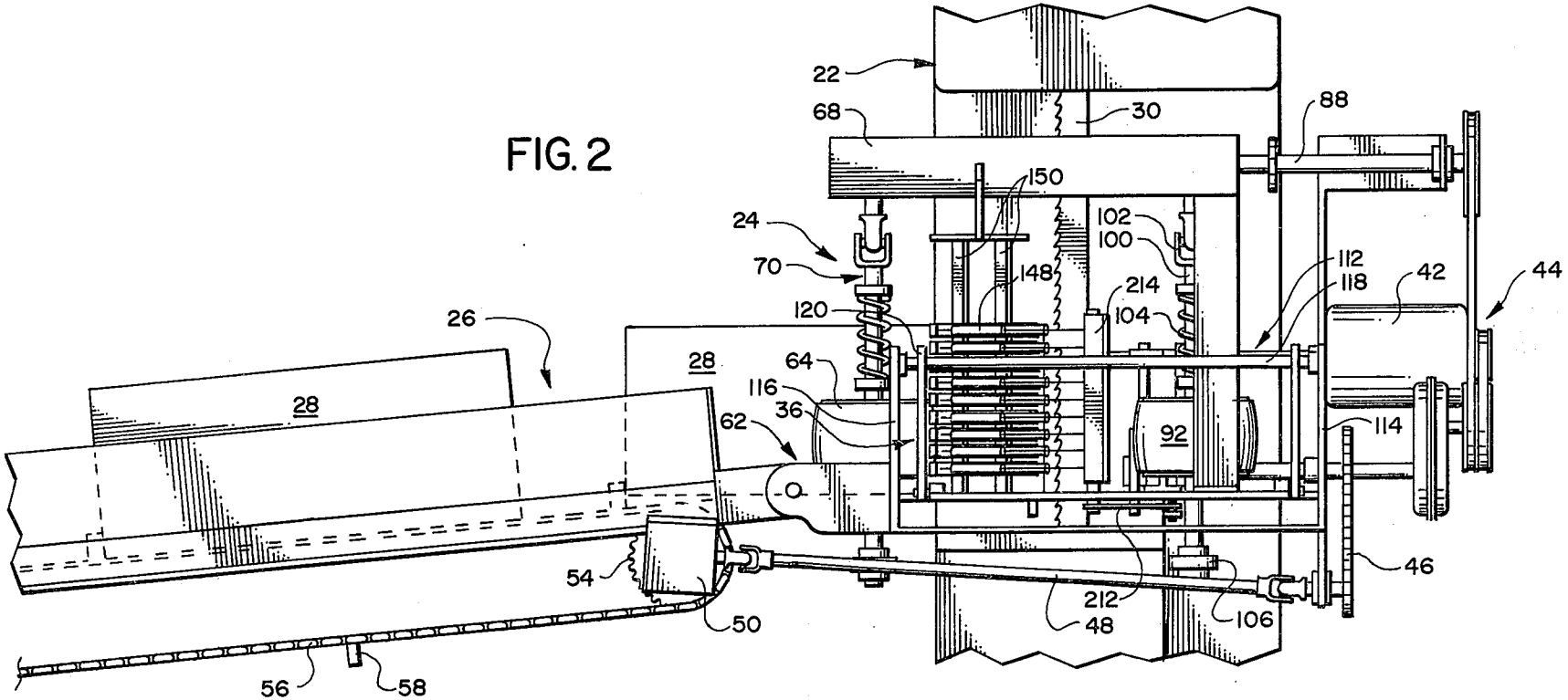
FIG. 2 is a side elevational view of the resaw apparatus of FIG. 1.

Turning to the figures of drawing, in each of which like parts are identified with like reference characters, FIGS. 1 and 2 illustrate the basic components of a shake resaw apparatus in accordance with the present invention, designated generally as 20. The overall apparatus is comprised of three basic components; a band saw designated generally as 22, a feed assembly designated generally as 24, and a conveyor means designated generally as 26. The conveyor 26 supports and directs a plurality of wooden blanks 28, each having a generally rectilinear configuration, to the feed assembly 24 which, in turn, guides the blanks through the band saw 22 and a moving blade 30 associated therewith in order to convert a blank 28 into a pair of oppositely tapered wooden shingles. Infeed drive means 32 cooperate with the conveyor means 26 to grasp a blank 28 as it reaches the end of the conveyor and direct it into a cutting zone proximate the blade 30. Outfeed drive means designated generally as 34 receive the sawn blank and direct the same outwardly of the feed assembly 24 for collection. During its travel through apparatus 20, and particularly as respects the resaw sequence, the blank 28 is subjected to a first tip-cutting stage as it engages the moving blade 30, an intermediate cutting stage generally along a diagonal, and a second tipcutting stage to yield the oppositely tapered shingles. Thus, the blank 28 is manipulated along a varying resaw path during the resaw sequence vis-a-vis the fixed position of blade 30.

Figure 7:
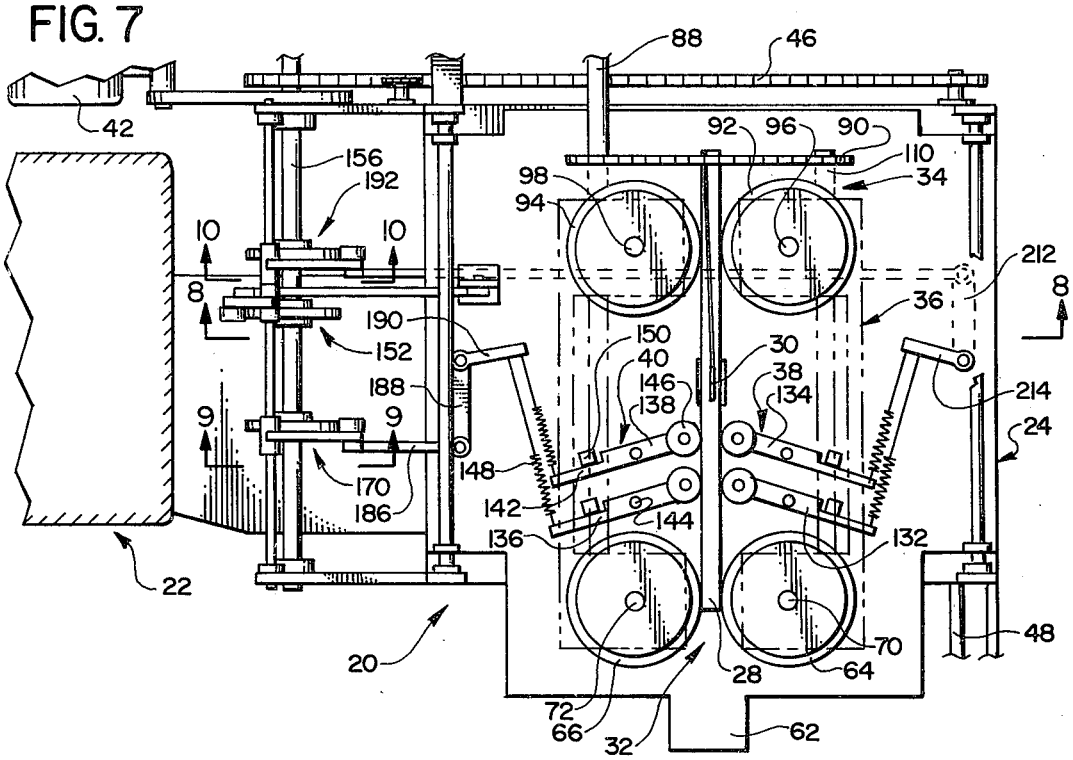
FIG. 7 is a top plan view, with parts broken away, like FIG. 1 but showing the apparatus during an intermediate diagonal-cutting stage of the resaw sequence.
Figure 11:
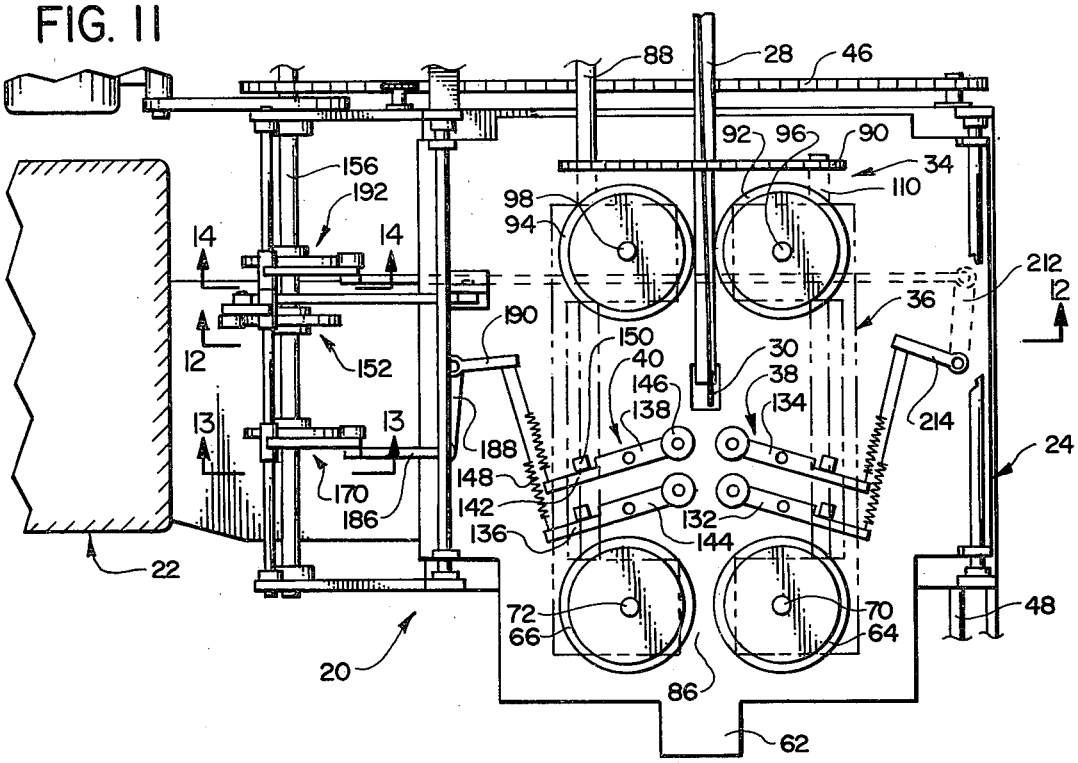
FIG. 11 is a top plan view, like FIGS. 1 and 7, but showing the apparatus during the final stage of the resaw sequence.

Comparing FIGS. 1, 7 and 11, which show respectively the initial, intermediate, and terminal stages of a resaw sequence, it can be seen that the apparatus 20 is configured to translate the blank 28 laterally from left to right during the resaw sequence; although, the blank could equally well be translated right to left should that prove desirable. The blank 28 is received on a support table designated generally as 36 hingedly disposed in cooperative engagement with the saw means 22 for lateral movement with respect to a longitudinal feed axis lying generally along the axis between the infeed and outfeed drive means through the blade 30. Thus, gross lateral movement of the blank 28 follows that of the support table 36 relative to the fixed position of the blade. Table control means, described in detail below, move the support table 36 along the lateral path, and preferably at a constant, predetermined rate.

The shake resaw apparatus 20 desirably provides the ability to establish with considerable precision the tip dimension for each end of the blank 28 and, with those dimensions established, divides the intermediate portion of the blank generally along a diagonal between the tip regions. Not only does this achieve vast improvements in uniformity, it permits the sawing of blanks having a wide range of thicknesses and achieves consistent results. These benefits are realized, in part, by utilization of first and second guide means 38 and 40, respectively, which control the blank as it progresses along its resaw path. These guide means provide guide surfaces of varying lateral stiffness and act as a type of rigid banking surface during the resaw sequence. Programmable control means, described in greater detail below, regulate the stiffness of the guide means during the resaw sequence to achieve this aim. More specifically, programmable guide control means associated with each of the guide means 38 and 40 preferably establish a minimum stiffness in the guide means 38 at the outset of the resaw sequence allowing its lateral deflection, but provide a greater, guiding-effective stiffness in the guide means 40 during that initial stage. Thus, as the blank enters the cutting zone of the apparatus it is driven by the infeed means 32 against the stiff surface provided by guide 40. Positioning the guide relative to the longitudinal feed axis establishes the proper tip dimension for the first tip-cutting stage of the sequence. The minimum-stiffness condition in the guide 38 insures that this alignment is maintained, in part by avoiding any competing forces between the guide members. As the blank progresses past the initial tip-cutting stage to the intermediate cutting stage, both guide means 38 and 40 are preferably rigid to provide guiding-effective control over the blank as the table 36 translates to the left, thereby establishing a diagonal cut in the blank leading to the second tip region. Accordingly, the programmable control means maintain the initial stiffness on (or rigidity of) the guide means 40 while establishing the same stiff condition for the guide means 38. As the blank continues to progress through the resaw sequence, it is now important to establish the proper tip dimension for the rear edge. The programmable control means assist that endeavor by relaxing the stiffness on the guide means 40 while maintaining the guide means 38 in the stiff condition previously established. Thus, as a correlary to the first tip-cutting stage, the blank is now driven against the stiff banking surface of the guide 38 while the guide 40 is free to move away in order to avoid a competing force (in the nature of force-fighting).

Each of the guide means 38 and 40, described in further detail below as respects the most preferred structure therefor, is disposed forwardly proximate the saw blade 30 and laterally displaced from the longitudinal feed axis therethrough. The dimension between a guide means, when in the rigid condition, and the feed axis dictates the tip widths of the shingle to be formed--that for guide means 38 controlling the second tip and that for guide means 40 controlling the first tip. Most preferably, therefore, each guide means is adjustably secured to allow for variation in the respective lateral offset from the feed axis to provide variation in the tip width achievable by the apparatus; thereby accommodating a fairly wide range of blank sizes. Indeed, the apparatus 20 is capable of converting blanks having a thickness of only about ⅜" into a pair of resawn shingles.

In the preferred embodiment shown, the feed assembly 24 and conveyor 26 are powered by a motor 42 through a transmission network designated generally as 44. Power for the conveyor 26 is transmitted via a chain 46 in cooperative engagement with drive shaft means 28 communicating with a gear box 50. The gear box 50, in turn, includes an output shaft 52 driving a sprocket 54 about which is disposed a conveyor chain 56. The conveyor chain 56 is provided with a plurality of ledge members 58 spaced one from another by a distance at least slightly greater than the length of each blank 28. Upright channel walls 60 along the upper edge of the conveyor 26 provide containment means for the blanks; permitting one to feed the blanks into the conveyor channel defined therebetween, whereupon the ledge 58 will engage the rearwardmost edge of the blank and move it upwardly in response to movement of the endless conveyor chain 56. The end of the conveyor is secured to a ramp-type member 62 in order to present the blank 28 at an appropriate position for engagement with the infeed means 32 which, as noted, have a somewhat greater speed to insure positive grasping. This may be achieved alternatively by timing the conveyor speed to be slightly slower, thereby effectuating the same relative difference.

Figure 3:
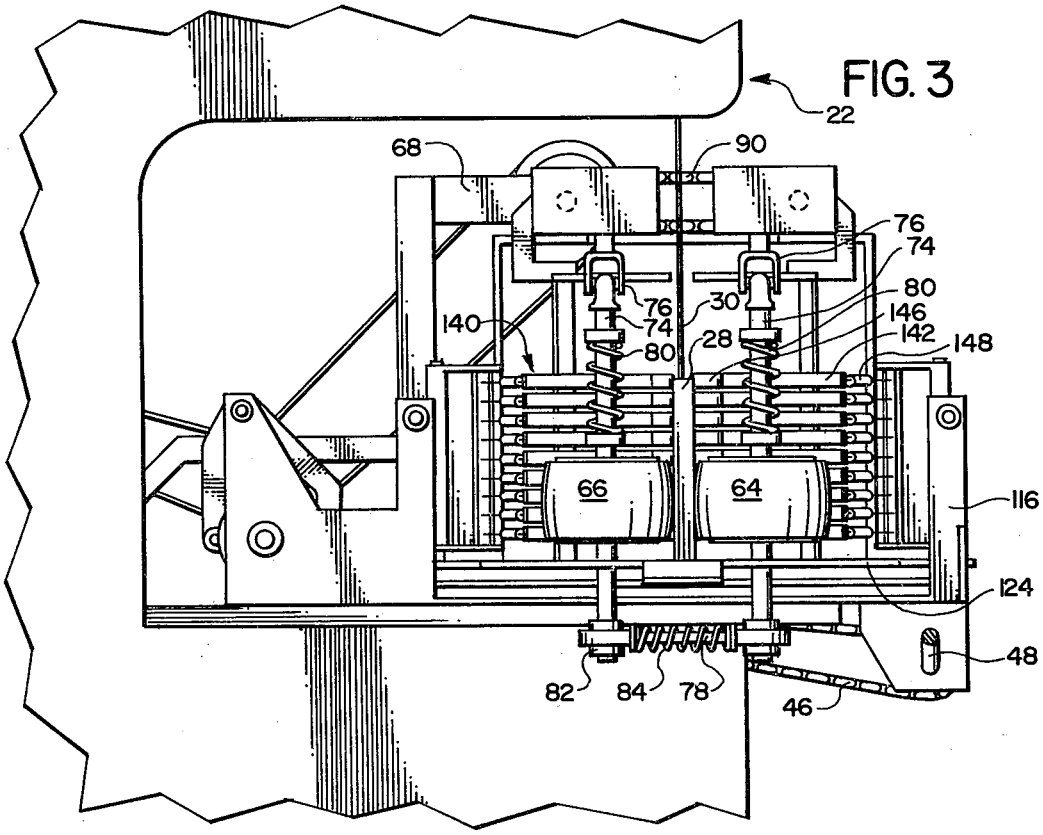
FIG. 3 is a sectional view taken substantially along the line 3—3 of FIG. 1, showing the apparatus in front elevation.

In this preferred embodiment, the infeed means 32 is comprised of a pair of roller members 64 and 66 depending from a frame 68 on floating drive members 70 and 72, respectively. The infeed rollers 64 and 66 are slaved together by the floating drive so that they will move in unison laterally but are capable of independent transverse (i.e., vertical) motion. This floating drive is desirable for its ability to yield a self-aligning feature for the infeed rollers so that the same will not interfere with the proper functioning of the guide means 38 and 40 as noted in general above. This goal is achieved in the preferred embodiment shown by providing each of the floating drives 70 and 72 with a shaft 74 coupled at the upper end to a U-joint 76 and passing downwardly through the respective roller member to a bridging arm 78. Each shaft 74 is provided with a spring 80 supporting the respective roller to maintain the pair in a normal driving position but allowing each to move independently in an upward or transverse direction against the spring. The bridging arm 78 joins the shafts 74 at couplings 82 with a spring 84 pulling the same together to maintain a desired drive gap dimension 86 (as viewed, e.g., in FIG. 11) irrespective of floating translation of the infeed assembly to insure positive feeding engagement between the roller and a blank to be sawn. Preferably, one or both of the couplings 86 is provided with a quick release mechanism permitting simple disconnection of the shafts 84 and associated rollers in order to gain access to the feed zone of the device. Driving power for the rollers is supplied from a drive shaft 88 passing through the housing 68. A drive chain 90, best viewed in FIG. 3, joins the shafts 74 for coincident rotation in order to maintain proper synchronization of the feed speed for the infeed rollers. Most preferably, the peripheral feed speed of the rollers 64 and 66 is slightly greater than the feed speed of the conveyor 26 to insure that the blank 28 is grasped positively as noted above; pulling the blank from the conveyor to avoid any tendency for jamming during the translation of the blank from the conveyor to the input feed.

The output feed drive means 34 are substantially identical in structure and operation to the infeed drive means 32. Accordingly, the same comprise first and second rollers 92 and 94 supported from frame 68 by floating drive members 96 and 98, respectively. Each of the floating drives includes a shaft 100 depending from a U-joint connection 102 through which power is transmitted via shaft 88. Each of the shafts 100 includes a spring 104 supporting the associated roller but nonetheless permitting transverse movement independent of the other roller member. The shafts 100 terminate in a bridging arm/spring arrangement, which may be the same as the arm 78 and spring 84, spanning the distance between couplings 106. Accordingly, an outfeed gap 108 is maintained by the self-aligning floating outfeed drive means 34. Optionally, but preferably, the same type of quick release feature is provided for the outfeed as discussed with reference to the infeed in order to permit rapid and simple separation of the individual rollers in order to gain access to the cutting zone of the apparatus; but this feature is not as important on the outfeed side as is the case on the infeed, which allows access to the saw blade for purposes of, e.g., changing the same. As is best viewed in FIG. 1, the power transmission for the infeed and outfeed rollers is common across the drive chain 90 from shaft 88 (and its continuous extension) and a cooperative shaft 110 to insure synchronous drive through the cutting zone proximate blade 30.

The support table 36 is hingedly disposed for its lateral displacement and translation of the blank 28 during the resaw sequence on a frame designated generally as 112. The frame 112 includes upright support members 114 and 116 associated with and resting upon the cutting surface of the band saw 22. A pair of arms 118 are positioned between the uprights 114 and 116 on either side of the feed section, shown in this preferred embodiment to be arms fabricated from round stock. Bars 120 are hingedly affixed to the arms 118 at four corners for pivotal movement thereon; preferably including bearings or bushings at pivot points 122 to allow free lateral translation of the support table. A table plate 124 is secured from the four bars 120, providing a surface for the support table 36 on which the blank rests and over which it passes during the resaw sequence. A fixture plate 126, best viewed, for example, in FIG. 4, extends upwardly from the table plate 124 and includes a boss receiving a translation arm 128 at a pivot 130. Accordingly, reciprocal movement of the arm 128 will cause the table to move laterally left and right about the pivots 122 in a horizontal plane. Most preferably, the table 36 is canted or skewed slightly with respect to the saw blade 30 for movement in this horizontal plane at a slight lateral angle; about 0.5° being adequate in most instances. This skewing tends to provide a very good cut along the diagonal during the intermediate cutting stage.

The translation of the table as immediately aforesaid causes the blade 30 to move diagonally across the thickness dimension of the blank 28, the progression being shown at three different stages in FIGS. 1, 7, and 11. It is important, however, that the cut be initiated at the leading edge of the blank 28 at a precisely located point and that the same condition obtains at the rearward edge in order to establish the desired tip thicknesses for the shingles ultimately to be produced. This aspect is one provided by the cooperative guide means 38 and 40 adjustably disposed on either side of the longitudinal feed axis. In this highly preferred embodiment, each of the guide means include two arrays of biased guide finger rollers. The guide means 38 is comprised of a first array designated generally as 132 forwardly disposed in respect of a second array 134. Likewise, the guide means 40 includes a first array 136 forwardly disposed of a second array 138. While each of the guide means conceivably might be comprised of only one or might be more than two such arrays, uniformity of results and dependability of operation are found to be properly balanced by this preferred implementation. Irrespective of that consideration, each array includes a plurality of biased guide fingers designated generally as 140. In the illustrative embodiment, the transverse array of fingers 140 has a dimension sufficient to provide guiding contact across the entire face of the blank 28. Each of the guide fingers includes an arm 142 disposed for pivotal rotation about a transverse stem 144 passing through the entire array. The distal end of each arm is provided with a roller 146 for contacting the face of the blank 28, providing a firm banking surface but which, by virtue of the roller, presents very little drag as the blank is fed for cutting. Each arm 142 is tensioned for rotation about the pivot of stem 142 by a spring 148, tending to rotate the arm and associated roller in a direction counter to the feed of the blank 28. A post 150 serves as a stop to limit rotation in that direction while allowing deflection of the arms against the variable force of biasing springs 148 in the direction of feed. As can be seen, for example in FIG. 1, the orientation of the arms 142 (and hence the guide means themselves) is on a slight angle with respect to the feed axis with the arms in butting, stopped engagement with the posts 150. By appropriately tensioning the biasing springs 148, the lateral stiffness of the arrays of guide fingers may be varied in a collective sense. Relaxing the spring tension will allow deflection of the arrays of rollers very easily, leaving the same without sufficient collective integrity to provide guiding effectiveness; whereas increasing the tension on the biasing springs 148 will stiffen the arrays to provide that guiding-effective stiffness and yield, in effect, a rigid banking surface against which the blank may be driven Nonetheless, since the guide means are comprised of a plurality of discrete guide fingers (nine of which are shown to constitute each separate array), a knot or other gross surface imperfection on the blank 28 will force that finger with which it engages to distend outwardly against the spring force of the individual biasing spring 148 associated with that arm while leaving the remaining fingers to provide the stiff banking surface guiding the blank during the cutting operation.

Figure 4:
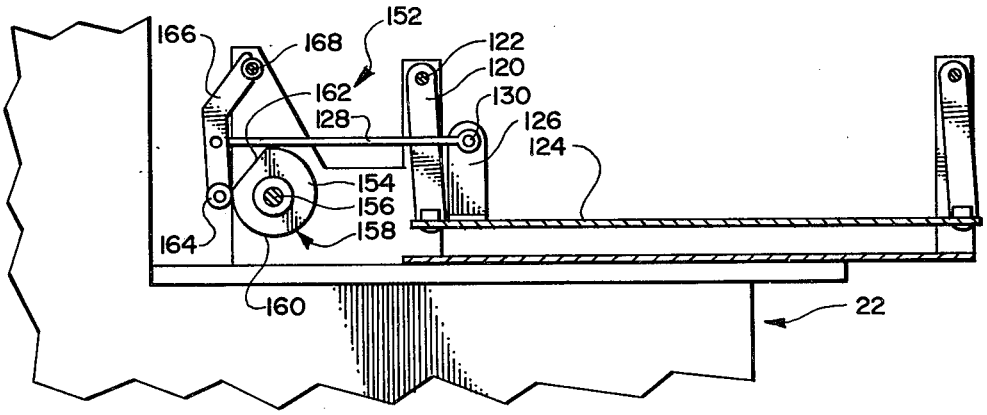
FIG. 4 is a sectional view, taken substantially along the line 4—4 of FIG. 1, showing table control means in the form of a cam at the initial stage of a resaw sequence.
Figure 5:
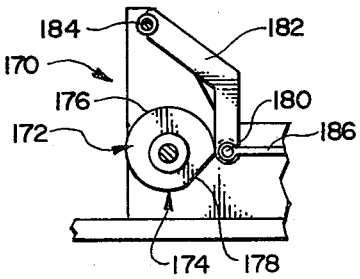
FIG. 5 is a sectional view taken substantially along the line 5—5 of FIG. 1, similar to FIG. 4 in illustrating a guide control means in the form of a cam at the initial stage of the sequence.
Figure 8:
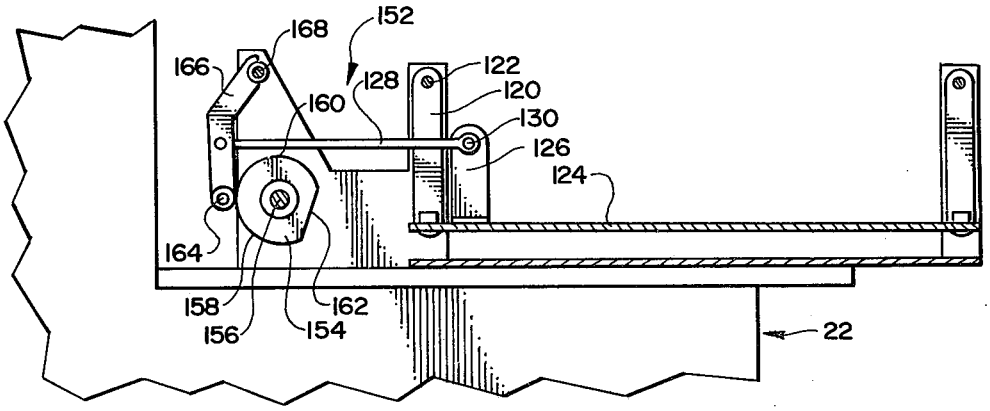
FIG. 8 is a sectional view taken substantially along the line 8—8 of FIG. 7, showing the table control means during this intermediate stage.
Figure 9:
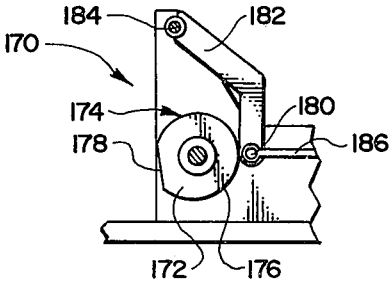
FIG. 9 is a sectional view taken substantially along the line 9—9 of FIG. 7, showing a guide control means during the intermediate stage of the resaw sequence.
Figure 12:
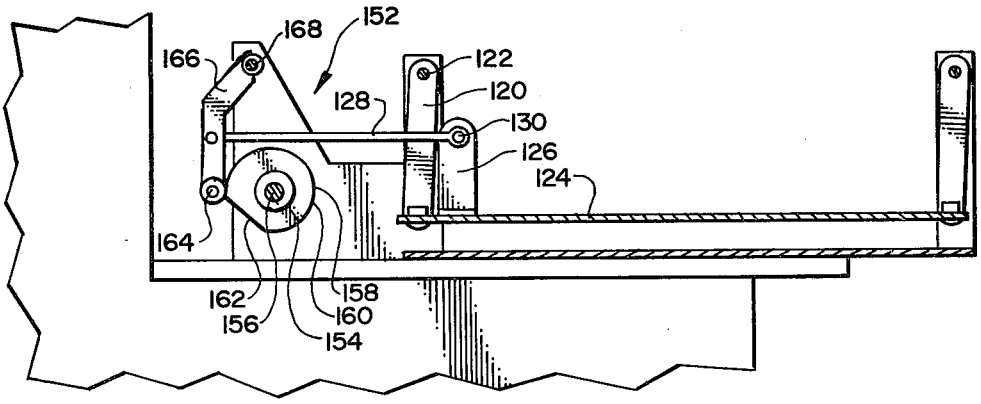
FIG. 12 is a sectional view taken substantially along the line 12—12, showing the table control means at this final stage during the resaw sequence.
Figure 13:
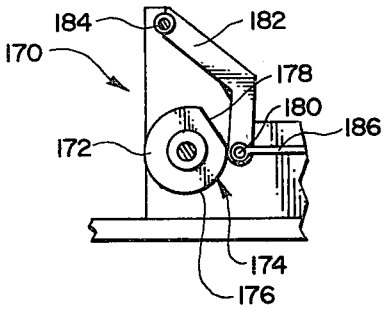
FIG. 13 is a sectional view taken substantially along the line 13—13 of FIG. 11, showing a guide control means at this final stage of the resaw sequence; and, FIG. 14 is a sectional view taken substantially along the line 14—14 of FIG. 11 showing the other guide control means at this final stage during the resaw sequence.
Figure 14:
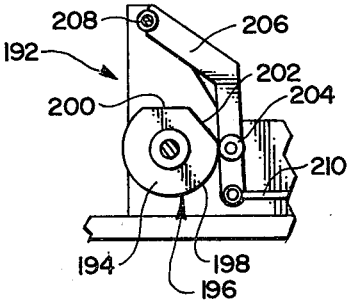

The manipulation of both the table support during its lateral translation and the tensioning and release of the biasing force on the guide means are regulated by programable control means; in the case of the present illustrative embodiment, those control means being comprised of cams and cam followers. A support table control means, designated generally as 152 and viewed for example in FIGS. 1 and 4, is comprised of a cam 154 secured for rotation with a shaft 156 communicating with the power transmission means 44. The cam 154 includes a cam surface 158, in this case having a curved portion 160 and a flat 162. A cam follower 164 is borne upon a pivotal arm 166 secured at a pivot 168 for mating engagement with the cam face 158. The translation arm 128 secured to the table plate 124 is disposed intermediate the length of the arm 166. Accordingly, rotation of shaft 156 causes corresponding rotation of the cam 154 which, by virtue of the variation in the curved portion 160 results in lateral translation of the table 124 from a start position shown in FIG. 4 (with the table pivotally disposed to the right) through an intermediate position, shown in FIG. 8, to an end position, shown in FIG. 12. Thereupon the cam 164 rides across the flat 162 to the start position and the table is ready for the next cutting sequence.

A similar guide control means, designated generally as 170, regulates the variable tensioning of the guide means 40. As best viewed in FIGS. 1 and 2, the guide control means 170 is comprised of a cam designated generally as 172 likewise secured to shaft 156 for coincident rotation therewith. Cam 172 includes a cam surface 174 having a curved portion 176 and a flat 178. A cam follower 180 is secured to the distal end of an arm 182 disposed for pivotal movement about a point 184. An arm 186 extends from the cam follower to a linkage 188 in operative engagement with an arm 190 to which the springs 148 associated with both arrays 136 and 138 are attached. Rotation of the shaft 156 to present the curved portion 176 of the cam in engagement with the cam follower results in a tensioning of the biasing spring means and a concomitant stiffening of the associated rollers to present a fairly rigid banking surface; whereas the presentation of the flat 178 relaxes that tension.

Figure 6:
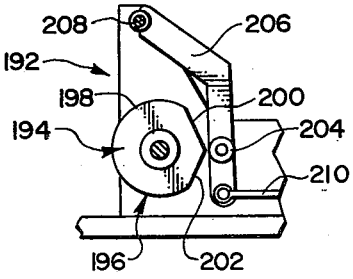
FIG. 6 is a sectional view, taken substantially along the line 6—6 of FIG. 1, and like FIGS. 4 and 5, shows guide control means in the form of a cam at the initial stage of a resaw sequence.

The guide means 38 are regulated in much the same manner, by guide control means 192 best viewed in FIGS. 1 and 6. As with the foregoing, guide control means 192 is comprised of a cam 194 secured to the shaft 156 for coincident rotation therewith. The cam 194 has a cam face 196 including a curved portion 198 and first and second flats 200 and 202. A cam follower 204 is disposed on an arm 206 secured for pivotal movement about pivot 208. An arm 210 extends from the arm 206 to a linkage 212 in operative engagement with an arm 214. The biasing springs 148 associated with each of the guide fingers comprising the guide 38 are secured to the arm 214, whereby the springs may be tensioned to present a stiff banking surface or relaxed to allow deflection of the guide members.

In operation, the resaw apparatus of the present invention is simple and yet highly efficient and reliable. With the band saw 22 energized to present a moving blade 30, blanks 28 are loaded within the channels of the conveyor 26. Synchronized power for the feed assembly 24 is provided via the motor 42 and transmission means 44. At the start, the table control is as shown in FIG. 4, presenting the table surface 124 to the extreme right of its motion. The guide members 40 are tensioned by virtue of the position of cam follower 180 on the curved portion 176 of cam 172. In turn, this yields a stiff banking surface against which the blank may be driven by the infeed assembly 32. Yet, should the blank 28 have a knot or similar gross surface protrusion, the individual guide roller engaging the same may nonetheless be displaced while leaving the remaining rollers to provide the stiff banking surface. At this initiation point, the guide means 38 are relaxed as the cam follower 204 is at the apex between the flats 200 and 202 on the control cam 194. This allows easy deflection of those guide members comprising the guide means 38 in order to present the tip of the blank 28 at the proper location vis-a-vis the moving blade 30. That tip dimension is easily regulated by appropriate adjustment of the guide means 40, shifting the same laterally toward or away from the feed axis to the desired tip width.

Figure 10:
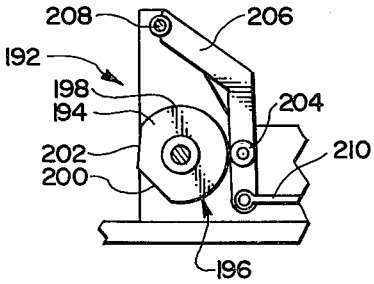
FIG. 10 is a sectional view taken substantially along the line 10—10 of FIG. 7, showing the other guide control means during this intermediate stage of the resaw sequence.

The blank is drawn into the saw by virtue of the infeed roller assembly 32 against the stiff banking surface provided by guide means 40 as the table is translated to the left, as best viewed in FIGS. 7–10. The initial or first tip-cutting stage of the resaw sequence is shown to be concluded in FIG. 7 and the intermediate cutting stage in progress. The cam 154 has rotated to allow the table to translate approximately midway its course of travel, thereby presenting the saw blade 30 intermediate the thickness dimension of the blank 28. The guide means 40 remain stiff as the cam follower 180 remains in contact with the curved portion of its surface. However, as shown in FIG. 10, the cam follower 204 has now ridden over the flat and is in contact with the curved portion 198 of the cam 194. This results in a tensioning of the guide means 38 so that the blank 28 is rigidly restrained between opposed stiff surfaces. The transition from initial relaxation of the guide means 38 to this guiding-effective configuration is controlled by the placement of flat 200 relative to the curved portion of the cam. It has been determined that the initial tip-cutting stage is most advantageously about one-third of the overall sequence, or perhaps somewhat less, before providing the guiding stiffness to the guide member 38. Certainly, the initial sequence could be more or less at the option of the designer and this is easily controlled by appropriate configuration of that cam. Regardless, the intermediate sequence continues until the time for cutting the second tip at the termination of the resaw sequence. That is best viewed with reference to FIGS. 11–14.

As the blank has progressed through the intermediate stage of the sequence, the second tip thickness is controlled in much the same way as described above with reference to the cutting of the first tip, excepting the fact that the roles of the guide members are now reversed. As shown in FIG. 11, the guide means 38 remain stiff to provide the firm banking surface while the guide means 40 are relaxed to permit lateral displacement. Again, the lateral displacement of the finger rollers constituting the guide 38 relative to the axis through the saw blade will dictate the tip thickness on the shingle being produced. As can be seen with reference to FIGS. 12–14, the table has been translated to its extreme leftward position by the cam 154, while the cams 172 and 194 have caused the associated guide members to present the desired degree of stiffness. During this terminal stage, the partially cut blank is now fed by the outfeed roller assembly 34 and the pair of oppositely tapered shingles may be recovered.

As is now evident from the foregoing description of this highly preferred exemplary embodiment of the shake resaw apparatus 20, the same is of very simple design thereby obviating both manufacturing difficulty and operational maintenance while nonetheless providing an extremely reliable and efficient machine for fabricating shake shingles. Accordingly, all of the benefits of conceptually similar apparatus destined for the same task are maintained while many of the significant drawbacks associated with their inherent complexity are effectively overcome.

While the invention has now been described with reference to such preferred embodiments, those skilled in the art will recognize that certain substitutions, changes, modifications, and omissions may be made without departing from the spirit thereof. Accordingly, it is intended that the scope of the present invention be limited solely by that of the claims granted herein.

What is claimed is:

1. Shake resaw apparatus for converting a generally rectilinear wooden blank into a pair of oppositely tapered shingles, each having a tip end and butt end, comprising:

a. a support table hingedly disposed for cooperative engagement with saw means for lateral movement with respect to a longitudinal feed axis along which a wooden blank progresses during a resaw sequence through said saw means, including a first tip-cutting stage, an intermediate diagonal-cutting stage, and a second tip-cutting stage;

b. table control means for moving said support table at a predetermined rate in a lateral path relative to said feed axis during said resaw sequence;

c. first and second blank guide means having variable lateral stiffness, one of each disposed on either side of said feed axis forwardly proximate a saw blade location thereon, for cooperatively routing said blank along a variable, predetermined resaw path;

d. first guide control means for regulating the lateral stiffness of said first blank guide means during said resaw sequence, permitting lateral deflection thereof during said first tip-cutting stage and establishing guiding-effective stiffness to provide a generally rigid guiding surface for said blank during the remainder of said sequence;

and, e. second guide control means for regulating the lateral stiffness of said second blank guide means during said resaw sequence, permitting lateral deflection thereof during said second tip-cutting stage and establishing guiding-effective stiffness to provide a generally rigid guiding surface for said blank during the remainder of said sequence.

2. The shake resaw apparatus of claim 1, wherein each of said blank guide means is comprised of at least one generally transverse array of a plurality of semi-independent guide finger means ganged for collective, variable biased response to the respective one of said guide control means and individual lateral deflection upon contact with surface irregularities in said blank.

3. The shake resaw apparatus of claim 2, wherein each of said transverse arrays is comprised of an array of said guide fingers having proximal and distal ends, disposed for lateral pivotal movement about a pivot point intermediate the length thereof, roller means at the distal ends of said fingers for contacting said blank, variable biasing means at the proximal ends of said fingers in operative communication with said guide control means for regulating the biasing force thereon, and stop means disposed intermediate said pivot point and said proximal end for limiting pivotal movement of said fingers in a direction counter to said resaw path.

4. The shake resaw apparatus of claim 3, wherein each of said blank guide means is comprised of at least two of said arrays of guide fingers disposed in spaced relationship with said roller means lying along a line generally parallel with said feed axis and displaced therefrom in an outwardly lateral direction to provide a guiding surface for said blank.

5. The shake resaw apparatus of claim 4, wherein the distance separating said roller means from said feed axis for said first guide blank means controls the tip dimension during said second tip-cutting stage and that for said second guide blank means controls the tip dimension during said first tip-cutting stage.

6. The shake resaw apparatus of claim 2, further comprising floating infeed rollers and floating outfeed rollers disposed respectively forward and rearward of said saw location for driving said blank along said resaw path.

7. The shake resaw apparatus of claim 6, further comprising conveyor means for delivering blanks to be resawn.

8. The shake resaw apparatus of claim 7, further comprising timing means for regulating the delivery of blanks from said conveyor means to said infeed rollers, wherein the relative angular speed of said rollers is timed slightly greater than the linear speed of said conveyor to provide positive grasping of a blank by the former from the latter.

9. The shake resaw apparatus of claim 2, wherein said table control means is comprised of table control cam means having cam followers and linkage means in operative engagement with said table for regulating the lateral travel thereof.

10. The shake resaw apparatus of claim 2, wherein said first and second guide control means are comprised of respective first and second guide control cam means, each having cam follower and linkage means in operative engagement with the respective one of said guide control means for regulating the stiffness thereof.

11. The shake resaw apparatus of claim 3, wherein said table control means is comprised of table control cam means having cam followers and linkage means in operative engagement with said table for regulating the lateral travel thereof.

12. The shake resaw apparatus of claim 11, wherein the first and second guide control means are comprised of respective first and second guide control cam means, each having cam follower and linkage means in operative engagement with the respective one of said guide control means for regulating the stiffness thereof.

13. The shake resaw apparatus of claim 12, wherein said table control cam means and said first and second guide control cam means include cams secured to a common drive shaft for coincident rotation therewith.

14. Shake resaw apparatus for converting a generally rectilinear wooden blank into a pair of oppositely tapered shingles, each having a tip end and a butt end, comprising:

a. a support table hingedly disposed for cooperative engagement with saw means for lateral movement with respect to a longitudinal feed axis along which a wooden blank progresses during a resaw sequence through said saw means, including a first tip-cutting stage, an intermediate diagonal-cutting stage, and a second tip-cutting stage;

b. table control cam means for moving said support table at a predetermined rate in a lateral path relative to said feed axis during said resaw sequence, including a cam member secured to a drive shaft for coincident rotation therewith and a cooperative cam follower including linkage means in operative engagement with said support table;

c. first and second blank guide means having variable lateral stiffness, one of each disposed on either side of said feed axis forwardly proximate a saw blade location thereon, for cooperatively routing said blank along a variable, predetermined resaw path, each of said guide means including first and second transverse arrays of guide fingers having proximal and distal ends disposed for lateral pivotal movement about a pivot point intermediate the length thereof, roller means at the distal end of said fingers for contacting said blank, variable biasing means at the proximal ends of said fingers for tensioning said fingers and biasing same for movement in a direction counter to said resaw path, and stop means disposed intermediate said pivot point and said proximal end for limiting pivotal movement of said fingers in a direction counter to said resaw path;

d. first guide control cam means for regulating the lateral stiffness of said first blank guide means during said resaw sequence, permitting lateral deflection thereof during said first tip-cutting stage and establishing guiding-effective stiffness to provide a generally rigid guiding surface for said blank during the remainder of said sequence, comprising a first guide control cam secured for coincident rotation with said drive shaft and cooperative first cam follower and linkage members, wherein said first linkage member is in operative communication with said variable biasing means for said first guide control means, whereby rotation of said first guide control cam tensions said variable biasing means during said intermediate diagonal-cutting stage and said second tip-cutting stage to provide a generally rigid guiding surface for said blank; and, e. a second guide control cam means for regulating the lateral stiffness of said second blank guide means during said resaw sequence, permitting lateral deflection thereof during said second tip-cutting stage and establishing guiding-effective stiffness to provide a generally rigid guiding surface for said blank during the remainder of said sequence, comprising a second guide control cam secured for coincident rotation with said drive shaft and cooperative second cam follower and linkage members, wherein said second linkage member is in operative communication with said variable biasing means for said second guide control means, whereby rotation of said second guide control cam tensions said variable biasing means during said first tip-cutting stage and said intermediate diagonal-cutting stage to provide a generally rigid guiding surface for said blank.

15. The shake resaw apparatus of claim 14, wherein said variable biasing means are comprised of spring means secured intermediate each of the proximal ends of said guide fingers and the respective guide control linkage members.

16. The shake resaw apparatus of claim 15, wherein each of said blank guide means is laterally adjustable with respect to said feed axis for regulating the tip thickness of said shingles.

17. The shake resaw apparatus of claim 15, wherein said support table is skewed laterally with respect to said saw means at an angle of about 0.5°.

18. In a shake resaw apparatus comprising a saw means for converting a generally rectilinear blank into a pair of oppositely tapered shingles, each having a tip end and a butt end, and a feed means for guiding said blank through said saw means, the improvement comprising blank guide means including first and second arrays of generally transverse guide fingers disposed on each side of a longitudinal feed axis along which said blank progresses during a resaw sequence through said saw means, each of said arrays comprising a plurality of semi-independent guide fingers disposed vertically upon a pivot member intermediate the length thereof, each of said fingers including roller means at the distal end thereof for contacting said blank and variable biased spring means at the proximal ends thereof; and programmable guide control means in operative communication with said variable bias spring means for regulating the tension therein during said resaw sequence.

19. The apparatus of claim 18, wherein said control means comprise cam means and cam follower means in operative communication with said variable bias spring means.

* * * * *